US009552936B2

(12) United States Patent
Kokubu

(10) Patent No.: US 9,552,936 B2
(45) Date of Patent: Jan. 24, 2017

(54) PUSH SWITCH

(71) Applicant: Valeo Japan Co., Ltd., Saitama (JP)

(72) Inventor: Taito Kokubu, Tokyo (JP)

(73) Assignee: Valeo Japan Co., Ltd. (JP)

( * ) Notice: Subject to any disclaimer, the term of this patent is extended or adjusted under 35 U.S.C. 154(b) by 39 days.

(21) Appl. No.: 14/452,018

(22) Filed: Aug. 5, 2014

(65) Prior Publication Data

US 2016/0042894 A1 Feb. 11, 2016

(51) Int. Cl.

| | |
|---|---|
| ***H01H 13/00*** | (2006.01) |
| ***H01H 15/00*** | (2006.01) |
| ***H01H 13/32*** | (2006.01) |
| ***H01H 3/42*** | (2006.01) |
| *H01H 1/40* | (2006.01) |

(52) U.S. Cl.

CPC ..... *H01H 13/32* (2013.01); *H01H 3/42* (2013.01); *H01H 1/403* (2013.01); *H01H 2300/01* (2013.01)

(58) Field of Classification Search

CPC ..... H01H 25/002; H01H 2221/014

USPC ..... 200/241, 242, 252, 253

See application file for complete search history.

(56) References Cited

U.S. PATENT DOCUMENTS

| | | | | |
|---|---|---|---|---|
| 3,916,150 A | | 10/1975 | Abernethy et al. | |
| 4,808,775 A | * | 2/1989 | Satoh | H01H 1/18 200/1 V |
| 5,659,162 A | * | 8/1997 | Hart | H01H 13/023 200/16 A |
| 5,667,062 A | * | 9/1997 | Yasufuku | H01H 13/12 200/252 |

FOREIGN PATENT DOCUMENTS

| | | |
|---|---|---|
| DE | 10 2006 036143 A1 | 2/2008 |
| DE | 20 2008 002853 U1 | 7/2009 |
| EP | 2 405 539 A2 | 1/2012 |
| JP | 2001-243850 | 9/2001 |

OTHER PUBLICATIONS

Extended European Search Report issued Jul. 31, 2014 for corresponding European Application No. 14 16 1183.

* cited by examiner

*Primary Examiner* — Renee S Luebke
*Assistant Examiner* — Lheiren Mae A Caroc
(74) *Attorney, Agent, or Firm* — Fishman Stewart PLLC

(57) ABSTRACT

A push switch is provided with a knob that causes the movable contact point in contact with the fixed contact point to slide thereon by a push operation of the knob, thereby connecting/disconnecting the movable contact point and the fixed contact point. A sliding direction of the movable contact point is set to a direction vertical to the push direction of the knob, and the push operation of the knob allows the movable contact point in contact with the fixed contact point to slide in a direction vertical to the push direction of the knob.

2 Claims, 6 Drawing Sheets

PUSH SWITCH

CROSS-REFERENCE TO RELATED APPLICATION

This application is related to Japanese Patent Application No. 2013-087845/2013 filed on Apr. 18, 2013

BACKGROUND OF THE INVENTION

Field of the Invention

The present invention relates to a push switch.

Description of the Related Art

There is known a push switch in which a movable board is moved in an operating direction of a knob by a push operation of the knob to cause a movable contact point provided on the movable board to slide on a fixed contact point (for example, Japanese Patent Laid-Open Publication No. 2001-243850).

FIG. 6A and FIG. 6B are diagrams for explaining the configuration of a push switch according to a conventional example represented by Japanese Patent Laid-Open Publication No. 2001-243850.

In a push switch 100 according to the conventional example, a movable board 104 having a movable contact point 104*a* is provided in a case 101 configured by assembling a cover 102 and a pole board 103 to be movable forward/backward in an operating direction of a knob 107 (upper-lower direction in FIGS. 6A and 6B).

The movable board 104 is positioned right under the knob 107 in the case 101, and an upper portion thereof is engaged to leg portions 108A and 108B extending downward from the knob 107 by an urging force acting on the movable board 104 from a spring Sp.

In the push switch 100, when the knob 107 moves downward in the side of the pole board 103 by the push operation of the knob 107, the movable board 104 is also pushed by the leg portions 108A and 108B of the knob 107 to move downward in the side of the pole board 103.

The movable contact point 104*a* is provided to project from a side face of the movable board 104, and makes push-contact with a fixed contact point 103*a* by an urging force of an unillustrated spring in a direction vertical to an operating direction of the knob 107, wherein the fixed contact point 103*a* is arranged to be lateral to the movable board 104.

The fixed contact point 103*a* is provided on a support wall 109 extending upward from the pole board 103, and is provided along a longitudinal direction (upper-lower direction in the figure) of the support wall 109 over a predetermined length.

Therefore, when the movable board 104 moves downward in the side of the pole board 103 by the push operation of the knob 107, the movable contact point 104*a* moves downward while sliding on a surface of the fixed contact point 103*a*.

Here, the support wall 109 is provided with a step portion 109*a* projecting closer to the movable board 104 than the fixed contact point 103*a* at a lower portion of the pole board 103 in the side of a bottom wall portion 103*c*. Therefore, when the knob 107 is pushed down from a reference position showed in FIG. 6A to move to an operation position shown in FIG. 6B, the movable contact point 104*a* gets on the step portion 109*a*, so that a contact state of the movable contact point 104*a* with the fixed contact point 103*a* is eliminated.

In addition, in the push switch 100, the operation of the knob 107 is detected when the movable contact point 104*a* gets on the step portion 109*a* to bring in a non-contact state between the movable contact point 104*a* and the fixed contact point 103*a*.

In the push switch 100 according to this conventional example, the movable board 104 (movable contact point 104*a*) positioned right under the knob 107 is moved forward/backward in the same direction as the operating direction of the knob 107 to connector disconnect the movable contact point 104*a* and the fixed contact point 103*a*.

Therefore, since it is necessary to ensure a space for moving the knob 107 and the movable board 104 within the case 101, a thickness of the push switch 100 results in becoming increased in the operating direction of the knob 107.

Therefore, in the push switch in which the movable contact point making contact with the fixed contact point is caused to slide to connect or disconnect the movable contact point and the fixed contact point, it is required to thin the thickness of the push switch in the operating direction of the knob.

SUMMARY OF THE INVENTION

Accordingly, the present invention is made in view of the above-described problems in the conventional push switch, and an object of the present invention is to provide a push switch that can thin a thickness of the push switch in an operating direction of a knob.

According to an aspect of the present invention, a push switch comprises a fixed contact point, a movable contact point that movably makes contact with the fixed contact point, and a knob that causes the movable contact point in contact with the fixed contact point to slide thereon by a push operation of the knob, thereby connecting/disconnecting the movable contact point and the fixed contact point, wherein a sliding direction of the movable contact point is set to a radial direction to the push direction of the knob.

According to the aspect of the present invention, since the sliding direction of the movable contact point in contact with the fixed contact point is set to the radial direction of the push direction of the knob, it is not necessary to ensure a space for the movable contact point to slide, in the push direction of the knob. Accordingly, it is possible to thin the thickness of the push switch in the operating direction of the knob as compared to the conventional push switch in which the movable contact point slide in the push direction of the knob.

BRIEF DESCRIPTION OF THE DRAWINGS

Other objects, features, and advantages of the present invention will become more apparent from the following detailed description made with reference to the accompanying drawings, in which like parts are designated by like reference numbers and in which:

FIG. 1A and FIG. 1B are diagrams for explaining the configuration of a switch device according to an embodiment in the present invention, wherein FIG. 1A is a perspective view showing the switch device and FIG. 1B is an exploded perspective view showing a push switch in the switch device;

Figure 4B:
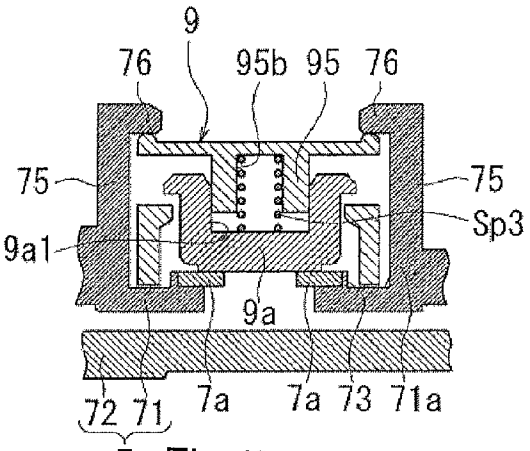
FIG. 4B is a cross section showing the push switch taken in the direction of lines A-A in FIG. 4A according to the embodiment.
Figure 4A:
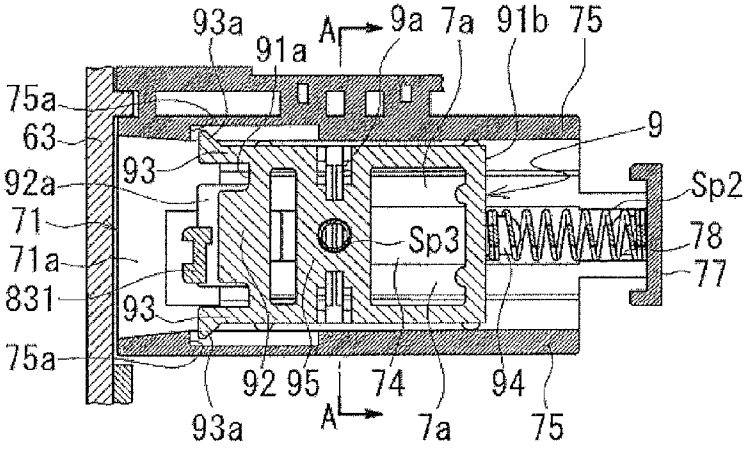
FIG. 4A is a cross section showing the push switch taken in the direction of lines C-C in FIG. 2 according to the embodiment.
Figure 4D:
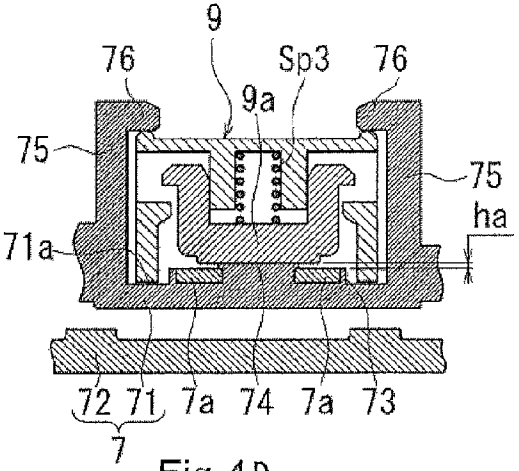
FIG. 4C is a cross section showing the push switch and explaining fixed contact points 7*a* exposed on an upper surface of a pole board according to the embodiment.
Figure 4C:
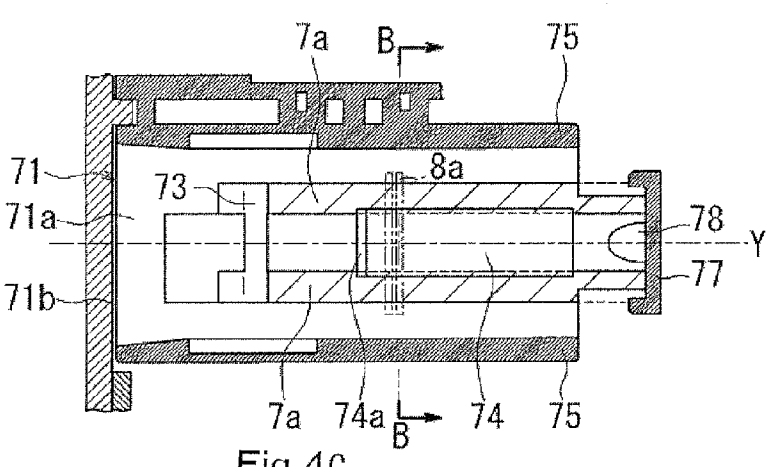

It is noted that FIG. 4C corresponds to a figure which omitted the movable board 9 and a spring sp2, and the hatching is attached on fixed contact points 7*a* which expose on the upper surface of the pole board 7.

Figure 5B:
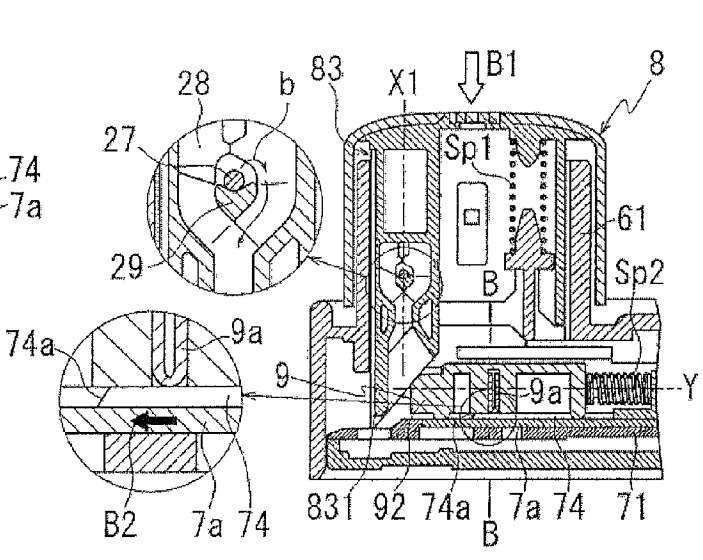
Figure 5D:
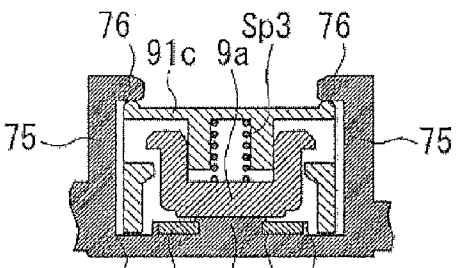
Figure 5A:
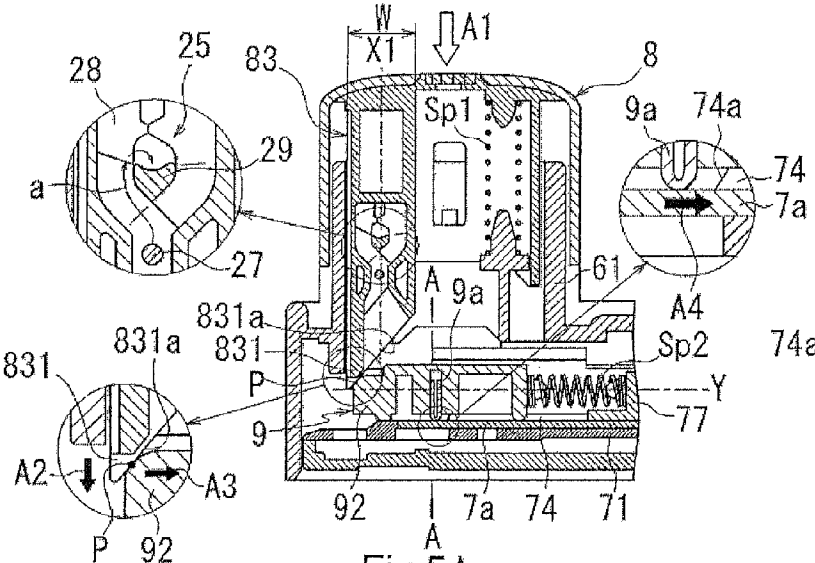
Figure 5C:
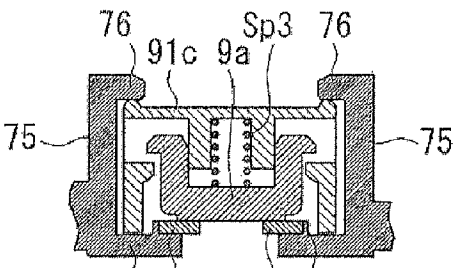
Figure 6B:
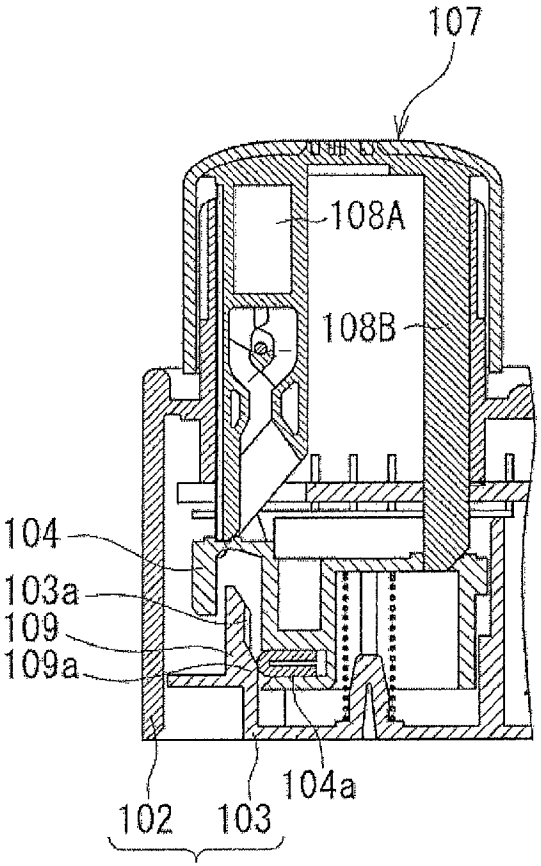
Figure 6A:
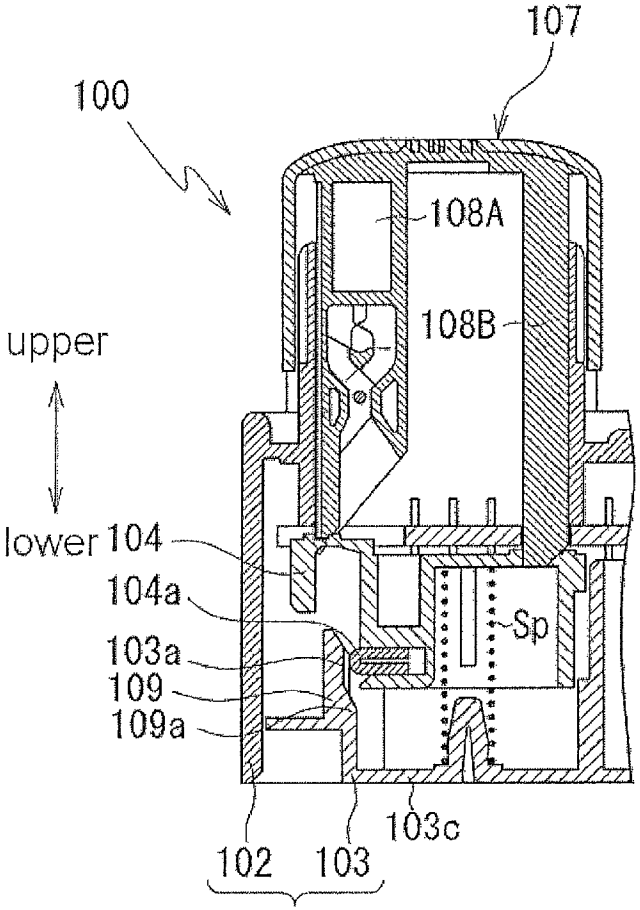

FIG. 4D is a cross section showing the push switch taken in the direction of lines B-B in FIG. 4C according to the embodiment;

FIG. 5A, FIG. 5B, FIG. 5C and FIG. 5D are diagrams for explaining an operation of the push switch according to the embodiment, wherein FIG. 5A is a cross section showing a state where a knob is arranged in a reference position, FIG. 5B is a cross section showing a state where the knob is pushed downward in the side of a pole board to be arranged in an operation position, FIG. 5C is a cross section taken along lines A-A in FIG. 5A, and FIG. 5D is a cross section taken along lines B-B in FIG. 5B; and FIG. 6A and FIG. 6B are diagrams for explaining a push switch according to the conventional example.

DESCRIPTION OF THE PREFERRED EMBODIMENTS

Hereinafter, an embodiment in the present invention will be explained with reference to the accompanying drawings by taking a push switch provided in a switch device as an example.

Here, in the following explanation, for descriptive purposes, a cover 6-side is described as "upward", a pole board 7-side is described as "downward", a push switch 2-side is described as "forward", and a swinging switch 4-side is described as "backward" in FIG. 1A as needed.

As shown in FIG. 1, a switch device 1 is configured such that plural switches 2, 3 and 4 are provided in a case 5 formed by assembling the cover 6 and the pole board 7.

The switch 2 is a push switch (hereinafter, referred to as "push switch 2") that switches on/off by a push operation of a knob 8, and the push switch 2 is provided with the knob 8, a movable board 9 that is operated by the knob 8, a movable contact point 9*a* that is provided in the movable board 9, and fixed contact points 7*a* that are provided in the pole board 7.

The knob 8 is supported by a cylindrical support wall portion 61 projecting upward from an upper surface of the cover 6 to be movable in the upper-lower direction.

In the push switch 2, when the knob 8 is operated to be pushed, the movable board 9 moves in a direction (axis line Y direction) vertical to the operating direction (axis line X direction) of the knob 8 by a leg portion 83 extending from the knob 8, and at this time, when the movable contact point 9*a* provided on the movable board 9 slides on the upper surface of the fixed contact point 7*a*, the push switch 2 switches on/off.

Figure 2:
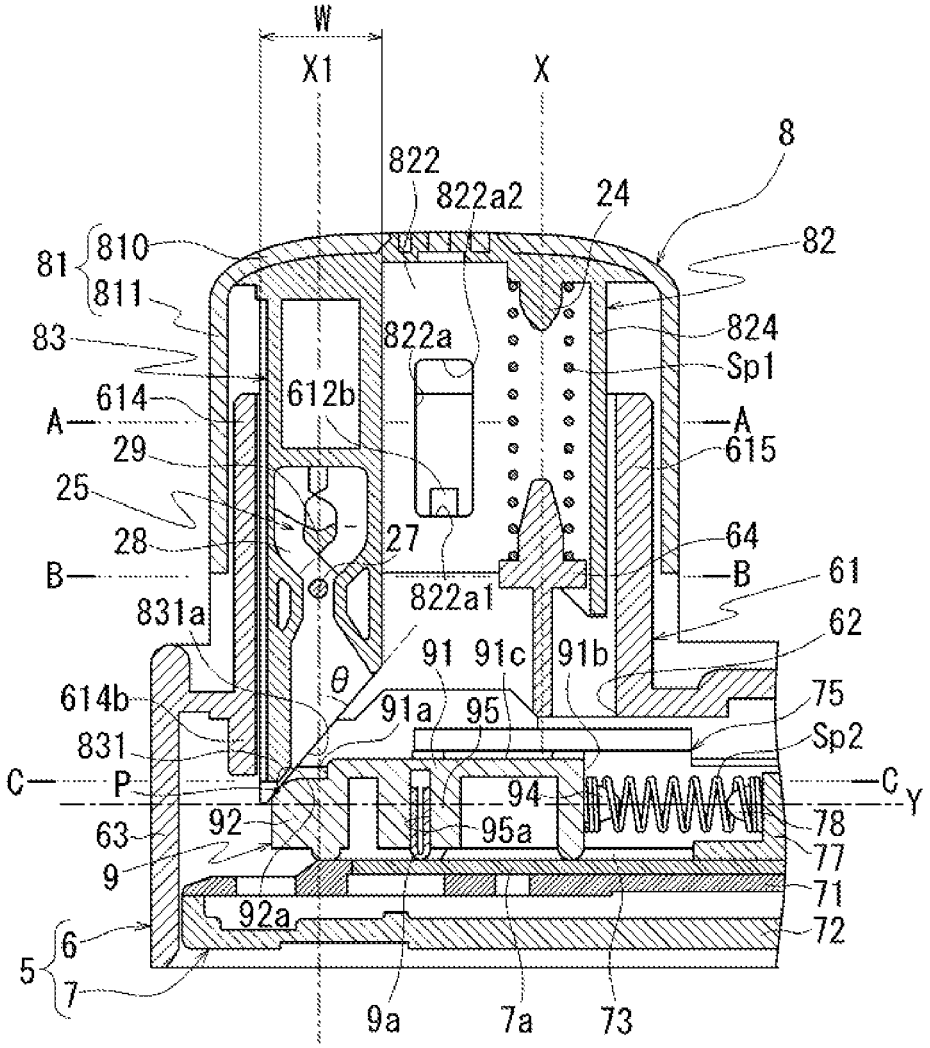
FIG. 2 is across section showing the push switch taken along a plane A in FIG. 1A according to the embodiment.

As shown in FIG. 2, the knob 8 has a push portion 81 that is pushed at the time of switching on/off the push switch 2, and the push portion 81 includes an upper wall portion 810 formed in a substantially rectangular shape in a plan view and a peripheral wall portion 811 surrounding a peripheral edge of the peripheral wall portion 810 over an entire periphery thereof.

A guide wall 82 guiding the movement of the knob 8 in the upper-lower direction and the leg portion 83 transmitting the operation of the knob 8 to the movable board 9 are provided inside the peripheral wall portion 811, and the knob 8 is supported by the support wall portion 61 in a state of inserting the support wall portion 61 in the side of the cover 6 between the guide wall 82 and the peripheral wall portion 811.

As shown in FIG. 2 and FIGS. 3A, 3B and 3C, the support wall portion 61 is provided to project upward from the cover 6 to surround an opening 62 formed in the cover 6, and includes side wall portions 612 and 613 extending in the front-back direction of the switch device 1 along a side edge of the opening 62, and side wall portions 614 and 615 extending in the right-left direction (width direction) of the switch device 1 along a side edge of the opening 62.

The side wall portions 612 and 613 are provided in parallel to each other, and end portions of the side wall portions 612 and 613 in the backward side are connected to each other by the side wall portion 615. A mounting wall 616 on which a plate spring 26 of a heart cam 25 which will be described later is mounted is provided in a front end of the side wall portion 613 to be in a position offset closer to the inside than the side wall portion 613, and the side wall portion 613 and the side wall portion 614 are connected through the mounting wall 616.

The mounting wall 616 is provided in parallel to the side wall portions 612 and 613, and ensures a space S1 between the side wall portion 612 and the mounting wall 616 to be able to insert the leg portion 83 into, which will be described later and forms a space S2 between the peripheral wall portion 811 of the knob 8 and the mounting wall 616 to be able to accommodate a lock pin 27 of the heart cam 25 and the plate spring 26.

Figure 3A:
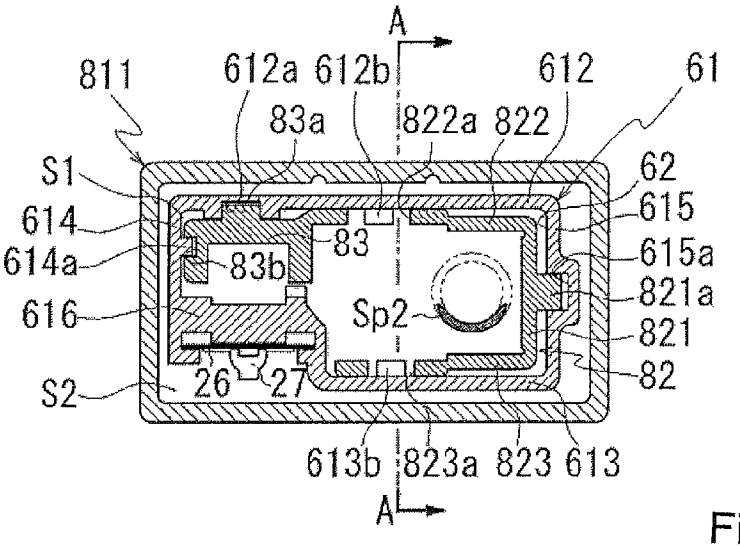
FIG. 3A is a cross section showing the push switch taken in the direction of lines A-A in FIG. 2 according to the embodiment.
Figure 3B:
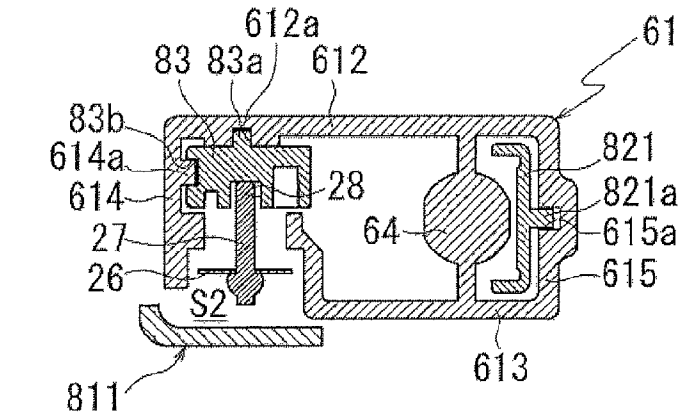
FIG. 3B is a cross section showing the push switch taken in the direction of lines B-B in FIG. 2 according to the embodiment.
Figure 3C:
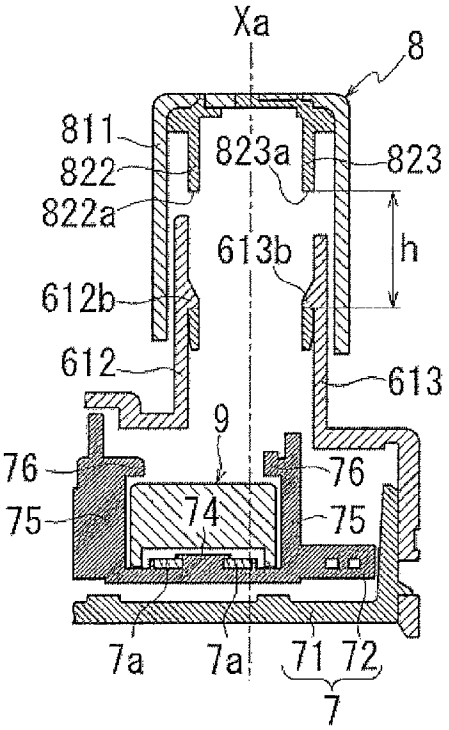
FIG. 3C is a cross section showing the push switch taken in the direction of lines A-A in FIG. 3A according to the embodiment.

As shown in FIG. 3A, the guide wall 82 with which the knob 8 is provided includes a wall portion 821 arranged along the side wall portion 615 in the backside of the support wall portion 61, and wall portions 822 and 823 extending in a direction vertical to the wall portion 821 from both ends of the wall portion 821. The guide wall 82 is formed in a reverse C-letter shape in a cross sectional view.

A projection 821*a* is provided in the halfway of the wall portion 821 in the longitudinal direction to project backward in the side of the side wall portion 615. The projection 821*a* is engaged to a guide groove 615*a* formed on an inner side surface of the side wall portion 615 in a state where the knob 8 is assembled in the cover 6.

The projection 821*a* in the side of the knob 8 and the guide groove 615*a* in the side of the side wall portion 615 are respectively provided along the upper-lower direction. Therefore, when the knob 8 is pushed to move downward in the side of the pole board 7, the projection 821*a* moves along the guide groove 615*a*, and thereby the movement in the backside of the knob 8 in the upper-lower direction is guided.

Wall portions 822 and 823 extend along the side wall portions 612 and 613 inside the side wall portions 612 and 613 of the support wall portion 61, and are provided with opening portions 822*a* and 823*a* in central parts thereof in the longitudinal direction to penetrate through the wall portions 822 and 823 in the thickness direction.

The opening portions 822*a* and 823*a* are respectively formed to have a predetermined length h (refer to FIG. 3C) along the side wall portions 612 and 613 in the upper-lower direction, and engagement portions 612*b* and 613*b* that are provided on an inner side surface of the side wall portions 612 and 613 in the support wall portion 61 are positioned to the opening portions 822*a* and 823*a* in a state where the knob 8 is assembled in the cover 6.

As shown in FIG. 2, in the present embodiment, urging forces of springs Sp1 and sp2 act on the knob 8, and the knob 8 is regularly urged in a direction (upper direction in the figure) of falling down from the support wall portion 61.

Therefore, when the force of pushing the knob 8 downward in the side of the pole board 7 does not act on the knob 8, the falling-down of the knob 8 from the support wall portion 61 is prevented by engagement of the engagement portions 612*b* and 613*b* in the side of the support wall portion 61 to lower edges of the opening portions 822*a* and 823*a* (in a case of FIG. 2, lower edge 822*a*1 of the opening portion 822*a*).

It should be noted that since the opening portions 822*a* and 823*a* are respectively formed to have a predetermined length h (refer to FIG. 3C) in the upper-lower direction in the side wall portions 612 and 613, even if the knob 8 is operated to move downward in the side of the pole board 7, the engagement portions 612*b* and 613*b* do not interfere with an upper edge 822*a*2 of the opening portion 822*a*. Therefore, at the time the knob 8 moves downward in the side of the pole board 7, the movement of the knob 8 is not interrupted by the engagement portions 612*b* and 613*b*.

As shown in FIG. 3A, the leg portion 83 in a substantially rectangular shape in a cross sectional view is formed to be integral with a front end of the wall portion 822.

As shown in FIG. 2, the leg portion 83 extends linearly toward the downward side in the side of the pole board 7, and a tip end portion 831 thereof makes contact with the movable board 9 in the case 5 in a state where the knob 8 is supported by the support wall portion 61.

As shown in FIG. 3A, a guide projection 83*a* engaging to a guide groove 612*a* of the side wall portion 612 is provided on an opposing surface of the leg portion 83 to the side wall portion 612, and a guide groove 83*b* engaging to a guide projection 614*a* of the side wall portion 614 is provided on an opposing surface of the leg portion 83 to the side wall portion 614.

The guide projection 83*a* and the guide groove 83*b* in the side of the leg portion 83, and the guide groove 612*a* and the guide projection 614*a* in the side of the support wall portion 61 are respectively provided in the upper-lower direction. When the knob 8 is pushed to move downward in the side of the pole board 7, the guide projection 83*a* in the side of the leg portion 83 and the guide projection 614*a* in the side of the support wall portion 61 respectively move along the guide grooves 612*a* and 83*b*, thereby the movement of the leg portion 83 (front side of the knob 8) is guided in the upper-lower direction.

Here, in the switch device 1, the leg portion 83 extending downward in the side of the pole board 7 from the knob 8 moves forward/backward in an axial direction of an axis line X1 (refer to FIG. 2) in association with an operation of the knob 8. When the knob 8 is pushed downward in the side of the pole board 7, the leg portion 83 moves in the same direction (downward in the side of the pole board 7) as that of the knob 8, and the tip end portion 831 in contact with the movable board 9 moves the movable board 9 in a direction vertical to the axis line X1 (axis line Y direction).

Therefore, when the leg portion 83 moves in a state of being inclined to the axis line X1 at this time, the tip end portion 831 and a contact point P between the tip end portion 831 and the movable board 9 which will be described later are shifted in a radial direction (axis line Y direction) of the axis line X1. Therefore, a position of the movable board 9 in the axis line Y direction is shifted out of a position in which the movable board 9 should be basically.

In the present embodiment, two guide mechanisms configured by the guide projections (83*a* and 614*a*) and the guide grooves (612*a* and 83*b*) are provided, which prevents the leg portion 83 from moving downward in the side of the pole board 7 in a state of being inclined to the axis line X1 at a push operation of the knob 8.

As shown in FIG. 2, at the backward side of the knob 8 in the front-back direction of the switch device 1, a spring support portion 24 that projects downward in the side of the pole board 7 is provided inside the guide wall 82.

One end of the spring Sp1 is mounted on the spring support portion 24 to be inserted around it, and the other end of the spring Sp1 is mounted to be inserted around a spring supporting portion 64 formed integrally with the cover 6.

The spring Sp1 is provided along the push direction (axis line X direction) of the knob 8 to exert an urging force in a direction (upper direction in the figure) of causing the knob 8 to fall down from the support wall portion 61 on the knob 8.

The leg portion 83 extending downward in the side of the pole board 7 from the knob 8 is positioned in the forward side of the knob 8 in the front-back direction of the switch device 1.

The leg portion 83 is provided along the push direction (axis line X1 direction) of the knob 8, and is provided in parallel to the spring Sp1 provided along the axis line X.

The leg portion 83 projects closer to the downward side in the side of the pole board 7 than the peripheral wall portion 811, and the tip end portion 831 thereof through which the opening 62 of the cover 6 penetrates is provided with an inclined surface 831*a* that makes contact with the contact portion 92 of the movable board 9.

The inclined surface 831*a* is provided at the backside of the leg portion 83 in the front-back direction of the switch device 1, and the inclined surface 831*a* is inclined by a predetermined angle θ to the operating direction (axis line X1) of the knob 8.

Therefore, the tip end portion 831-side of the leg portion 83 has a width W in the front-back direction of the switch device 1 that is narrower toward the downward side in the side of the pole board 7, and the leg portion 83 causes the inclined surface 831*a* provided in the tip end portion 831 to make contact with the contact portion 92 of the movable board 9 from the upper side in the upper-lower direction of the switch device 1.

The movable board 9 is provided to be movable forward/backward in a direction (axis line Y direction) vertical to the operating direction (axis line X/X1 direction) of the knob 8 by a terminal holding portion 71. When the leg portion 83 moves in the operating direction (axis line X/X1 direction) of the knob 8, a position of the contact point P between the inclined surface 831*a* of the leg portion 83 and the contact portion 92 of the movable board 9 changes in the axis line Y direction, and thereby, a position of the movable board 9 in the axis line Y direction changes in association with the operation of the knob 8.

As shown in FIG. 1, the movable board 9 is provided with a rectangular main body portion 91 in a plan view, and the contact portion 92 that makes contact with the leg portion 83 as described above is provided in one end 91*a* of the main body portion 91 at the forward side in the longitudinal direction.

The contact portion 92 is formed to project forward from the one end 91*a* of the main body portion 91, and has a width W2 narrower than a width W1 of the main body portion 91.

As shown in FIG. 2, an upper surface of the contact portion 92 at the tip end side is formed as a contact surface 92*a* having an arc-shaped outer periphery in a cross sectional view, and the inclined surface 831*a* of the leg portion 83 makes contact with the contact surface 92*a* from the upper side.

Figure 1B:
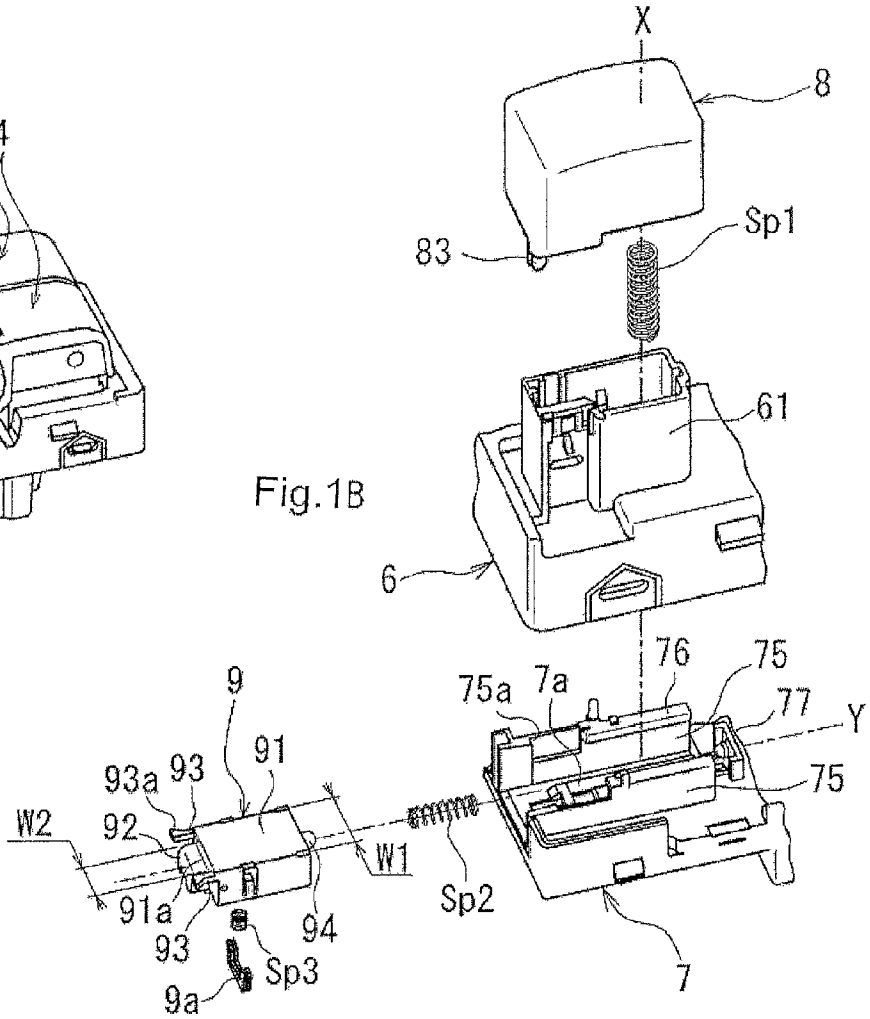
Figure 1A:
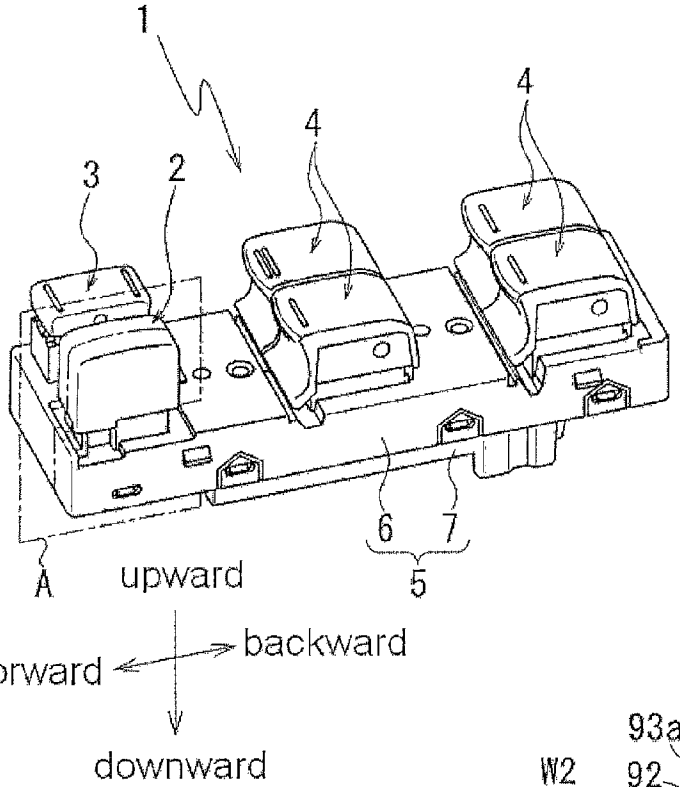

As shown in FIG. 1B and FIG. 4A, arm portions 93 extending in the same direction as that of the contact portion 92 from the one end 91*a* of the main body portion 91 are provided in both sides of the contact portion 92.

The arm portions 93 are columnar members extending linearly in the longitudinal direction of the main body portion 91, and engagement portions 93*a* are provided in the tip end portions of the arm portions 93 to project outward from the main body portion 91 in the width direction.

A columnar projection 94 is provided in the other end 91*b* of the main body portion 91 at the opposite side to the contact portion 92. The projection 94 projects backward of the switch device 1 from the central part of the main body portion 91 in the width direction, and one end of the spring Sp2 is mounted on the outer periphery to be fitted around it.

The other end of the spring Sp2 is mounted to be fitted around a projection 78 provided in a holding portion 77 in the side of the pole board 7, and the spring Sp2 is, when the movable board 9 is assembled in the pole board 7, provided at a compression state between the main body portion 91 and the holding portion 77.

At this time, the movable board 9 is pushed to the forward side of the switch device 1 by the urging force acting from the spring Sp2 to engage the engagement portions 93*a* of the aforementioned arm portions 93 to engagement grooves 75*a* of guide plates 75, thus preventing the movable board 9 from falling down from the guide plates 75.

Here, the contact portion 92 of the movable board 9 makes contact with the inclined surface 831*a* of the leg portion 83 from the axis line Y direction by the urging force acting from the spring Sp2, and the spring Sp2 moves the knob 8 upward in the figure, and at the same time, exerts the urging force in the direction of moving the position of the contact point P between the inclined surface 831*a* and the contact portion 92 to the forward side (left side in the figure) of the switch device 1.

Therefore, the urging force of the spring Sp2 acts on the forward side of the knob 8, in which the leg portion 83 is provided, in the direction of moving the knob 8 in the upper direction in the figure (direction of causing the knob 8 to fall down from the support wall portion 61).

In the present embodiment, a support wall portion 614*b* is provided forward of the tip end portion 831 of the leg portion 83 along the tip end portion 831. The support wall portion 614*b* extends on an extension line of the side wall portion 614 of the support wall portion 61 in the case 5, which prevents the side of the tip end portion 831 of the leg portion 83 from being inclined to the axis line X1 by the urging force of the spring Sp2 causing the contact portion 92 of the movable board 9 to make push-contact with the inclined surface 831*a*. Further, the support wall portion 614*b* also acts as a guide at the time the leg portion 83 moves forward/backward in the axis line X1 direction.

As shown in FIG. 2, a lower part of the main body portion 91 in the side of the pole board 7 is formed in a hollow shape, and a spring holding portion 95 is provided in the central part of the main body portion 91 in the longitudinal direction. An accommodation groove 95*a* is formed in the central part of the spring holding portion 95 along the width direction of the main body portion 91, and the movable contact point 9*a* is accommodated in the accommodation groove 95*a*.

The movable contact point 9*a* is formed by bending one sheet of metallic plate, and has a substantial U-letter shape in a cross sectional view. As shown in FIG. 4B, a concave portion 9*a*1 that is engaged to the spring Sp3 is formed in the central part of the movable contact point 9*a* in the width direction.

One end of a spring Sp3 projecting downward from the spring holding portion 95 makes contact with the central part of the concave portion 9*a*1 in the width direction, and the other end of the spring Sp3 is inserted in a cylindrical spring holding hole 95*b* provided in the spring holding portion 95.

The movable contact point 9*a* is movable in the upper-lower direction by the spring Sp3 accommodated in the spring holding hole 95*b*, and a lower surface of the movable contact point 9*a* is caused to make push-contact with the fixed contact points 7*a* provided in the side of the pole board 7 by an urging force acting from the spring Sp3.

As shown in FIG. 4C, the fixed contact points 7*a* in the pole board 7 are provided in parallel to each other to be spaced in the width direction of the switch device 1, and extend linearly in the movement direction (axis line Y direction) of the movable board 9.

The fixed contact points 7*a* are formed to be integral with the terminal holding portion 71 of the pole board 7 by insert molding, and in the terminal holding portion 71, the fixed contact points 7*a* are exposed on an upper surface of a projecting portion 73 projecting upward from an upper surface 71*a* of the terminal holding portion 71.

The terminal holding portion 71 is placed on an upper surface of a lower cover portion 72, and the fixed contact points 7*a* insert-molded in the terminal holding portion 71 are connected to an unillustrated print board placed on the upper surface of the lower cover portion 72 as similar to other wiring members provided in the terminal holding portion 71.

As shown in FIG. 4C, the projecting portion 73 in which the fixed contact points 7*a* are provided has a rectangular shape in a plan view, and extends linearly in the same direction (right direction in the figure) as the fixed contact points 7*a*.

A holding portion 77 holding the other end of the above spring Sp3 is provided to project in the same direction as the projecting portion 73 on an extension line from the backward side (right side in FIG. 4C) of the projecting portion 73.

A step portion 74 projecting closer to the upward side to the knob 8 than the projecting portion 73 is provided in the holding portion 77 side in the projecting portion 73. The step portion 74 extends in the same direction as the fixed contact points 7*a* between the fixed contact points 7*a*, 7*a* and is formed in a rectangular shape in a plan view.

An inclined surface 74*a* is provided in the end portion of the step 74 at the forward side (left side in the figure), having a height from the projecting portion 73 that is lower toward the forward side of the step portion 74. In a case where the movable board 9 (movable contact point 9*a*) moves to the side of the holding portion 77 (right side in the figure) by an operation of the knob 8, when the movable contact point 9*a* gets through the inclined surface 74*a* on the step portion 74, the movable contact point 9*a* is arranged in a position away by a predetermined height ha upward from the fixed contact point 7*a* (refer to FIG. 4D).

As shown in FIG. 4C, a pair of guide plates 75 for guiding the movement of the movable board 9 in the axis line Y direction are provided at both sides of the fixed contact point 7*a* in the width direction of the switch device 1.

The guide plates 75 are provided in parallel to each other along the movement direction (axis line Y direction) of the movable board 9, and are provided linearly in a range from the end portion 71*b* of the terminal holding portion 71 in the forward side (left side in the figure) to the vicinity of the holding portion 77.

The guide plates 75 are provided to project upward from the terminal holding portion 71 of the pole board 7, and stoppers 76 are provided on the upper end portions of the guide plates 75 for preventing the movable board 9 arranged between the guide plates 75, 75 from falling down to the upward side in the figure.

The stoppers 76 in the guide plates 75 are provided at the backward side thereof in the side of the holding portion 77, and engagement grooves 75*a* engaging to engagement portions 93*a* provided in the arm portions 93 of the movable board 9 as described above are provided in the forward side of the guide plates 75 adjacent to the stoppers 76.

Hereinafter, an operation of the push switch 2 will be explained. FIGS. 5A to 5D are diagrams for explaining the operation of the push switch 2.

As shown in FIG. 5A and FIG. 5C, in a state where the knob 8 is arranged in a reference position, the inclined surface 831*a* provided in the leg portion 83 of the knob 8 makes contact with the contact portion 92 of the movable board 9 in a position that is the farthest from the holding portion 77 in the axis line Y direction.

When the knob 8 moves downward in the side of the pole board 7 from this state by a push operation of the knob 8 (refer to an arrow A1 in the figure), the leg portion 83 of the knob 8 also moves downward in the side of the pole board 7 (refer to an arrow A2 in the figure).

Then, since a width W of the tip end portion 831 of the leg portion 83 is wider toward the upper side in the figure, as the leg portion 83 moves downward in the side of the pole board 7, the contact point P between the inclined surface 831*a* and the contact portion 92 of the movable board 9 in the movement direction (axis line Y direction) of the movable board 9 moves in the right direction in the figure.

As a result, the movable board 9 is pushed by the leg portion (inclined surface 831*a*) to move to the side of the holding portion 77 (an arrow A3 direction in the figure), and therefore, the movable contact point 9*a* provided in the movable board 9 moves in the right direction in the figure (an arrow A4 direction in the figure) while sliding on the upper surface of the fixed contact point 7*a*.

The step portion 74 is provided in the pole board 7 (terminal holding portion 71) to project closer to the upward side in the side of the knob 8 than the fixed contact point 7*a*, and this step portion 74 is provided in a position closer to the holding portion 77 between the fixed contact points 7*a*, 7*a*. Therefore, the movable contact point 9*a* that has moved to the right side in the figure by a push operation of the knob 8 finally climbs the inclined surface 74*a* provided in the step portion 74 to get on the step portion 74. When the movable contact point 9*a* gets on the step portion 74, the movable contact point 9*a* is arranged in a position away from the fixed contact point 7*a* (refer to FIG. 4D and FIG. 5D).

Here, in the push switch 2 in the present embodiment, the heart cam 25 is provided in a substantially central part of the leg portion 83 in the longitudinal direction. The heart cam 25 has a cam groove 28 provided in the leg portion 83 and the lock pin 27 that is engaged to the cam groove 28. The lock pin 27 is provided to penetrate through the mounting wall 616 (refer to FIGS. 3A and 3B), and is provided such that one end thereof is caused to make push-contact with the cam groove 28 by an urging force acting from the plate spring 26 provided in the mounting wall 616.

In the present embodiment, when the knob 8 is operated to be pushed downward in the side of the pole board 7, the lock pin 27 provided in the mounting wall 616 and the cam groove 28 move relatively in the upper-lower direction (axis line X1 direction), and a contact position of the lock pin 27 with the cam groove 28 changes along a trace shown in an arrow a in FIG. 5A.

When the push operation of the knob 8 is eliminated after moving the knob 8 downward in the figure, since the knob 8 is urged upward in the figure by urging forces acting from the springs Sp1 and Sp2, the engagement portion 29 of the heart cam 25 is engaged to the lock pin 27 from the lower direction in the figure to restrict the movement of the upper side of the knob 8 (refer to FIG. 5B).

Therefore, when the knob 8 of the push switch 2 that is in a reference position (refer to FIG. 5A) is pushed down by one time, the lock pin 27 is engaged to the engagement portion 29 to hold the knob 8 to an operation position (refer to FIG. 5B) arranged closer to the downward side in the side of the pole board 7 than the reference position.

Here, the leg portion 83 of the knob 8 is provided with two guide mechanisms (refer to FIG. 3A) configured by guide projections (83*a*, 614*a*) and guide grooves (612*a*, 83*b*). Since the movement of the knob 8 in the axis line X1 direction is guided by the guide mechanisms, at the push operation time of the knob 8, the leg portion 83 does not move downward in the side of the pole board 7 in a state where the leg portion 83 is inclined to the axis line X1.

When the knob 8 in the operation position shown in FIG. 5B is pushed downward of the pole board 7 (refer to FIG. 5B and an arrow B1 in the figure), the lock pin 27 and the cam groove 28 move relatively in the upper-lower direction (axis line X1 direction) to release the engagement between the lock pin 27 and the engagement portion 29.

At this time, the position of the lock pin 27 and the engagement portion 29 is shifted in an axial direction of the axis line Y by the inclination of the cam groove 28. Therefore, when the push operation of the knob 8 is released after pushing down the knob 8, the contact position between the lock pin 27 and the cam groove 28 changes along the trace shown in an arrow b in FIG. 5B.

Thereby, the knob 8 moves in a direction (upper direction in the figure) of falling down from the support wall portion 61 to be back to the reference position shown in FIG. 5A.

At this time, since the leg portion 83 of the knob 8 moves upward in the figure, the contact point P between the movable board 9 urged by the spring Sp2 and the leg portion 83 moves to the left side in the movement direction (axis line Y direction) of the movable board 9 following the movement of the leg portion 83.

Then, the movable contact point 9*a* provided in the movable board 9 moves to the left side in the figure while sliding on the upper surface of the step portion 74 (refer to an arrow B2 in the figure). In addition, when the movable contact point 9*a* reaches a position where the step portion 74 is not provided, the movable contact point 9*a* slides on the upper surface of the fixed contact point 7*a* in a state of making push-contact with the fixed contact point 7*a* by the urging force of the spring Sp3.

In addition, the fixed contact points 7*a* are communicated through the movable contact point 9*a* in a point when the movable contact point 9*a* makes contact with the fixed contact points 7*a*, thus creating a state where the push switch 2 switches off.

It should be noted that at the time the knob 8 moves from the operation position shown in FIG. 5B to the reference position shown in FIG. 5A, an urging force from the spring Sp1 interposed between the spring support portion 64 formed to be integral with the cover 6 and the spring support portion 24 in the side of the cover 6 acts on the backward side of the knob 8 in the front-back direction of the switch device 1, and an urging force from the spring Sp2 acting on the movable board 9 with which the leg portion 83 has made contact acts on the forward side of the knob 8.

In the present embodiment, the urging force of the spring Sp1 acting on the backward side of the knob 8 is set to be substantially the same as the urging force of the spring Sp2 acting on the forward side thereof. Therefore, the knob 8 can move upward in the figure without being inclined to the axis line X1.

As described above, according to the present embodiment, in the push switch 2 in which the push operation of the knob 8 causes the movable contact point 9*a* making contact with the fixed contact point 7*a* to slide thereon, thus connecting/disconnecting the movable contact point 9*a* and the fixed contact point 7*a*, the sliding direction of the movable contact point 9*a* is set to the radial direction (axis line Y direction) of the push direction (axis line X, X1 direction) of the knob 8.

According to this configuration, since the sliding direction of the movable contact point 9*a* making contact with fixed contact point 7*a* is the radial direction (axis line Y direction) of the push direction (axis line X, X1 direction) of the knob 8, it is not necessary to ensure the space for the movable contact point 9*a* to slide in the push direction (axis line X, X1 direction) of the knob 8.

Accordingly, the thickness of the push switch 2 in the push direction (axis line X, X1 direction) of the knob 8 can be made thinner than that of the conventional push switch in which the movable contact point slides in the push direction of the knob.

The movable contact point 9*a* is provided in the movable board 9 that is movable in the radial direction (axis Y direction) of the push direction (axis line X, X1 direction) of the knob 8, and the knob 8 has the leg portion 83 extending in the push direction (axis line X, X1 direction), and the inclined surface 831*a* (inclined portion) having a width W in the axis line Y direction that is narrower toward the tip end is provided in one side of the tip end portion 831 of the leg portion 83 in the movement direction (axis line Y direction) of the movable board 9. The knob 8 is provided such that the inclined surface 831*a* makes contact with the movable board 9.

According to this configuration, when the leg portion 83 of the knob 8 moves in the push direction (axis line X, X1 direction) of the knob 8 by the push operation of the knob 8, the contact point P between the inclined surface 831*a* provided in the leg portion 83 and the movable board 9 displaces in one side in the movement direction (axis line Y direction) of the movable board 9 to move the movable board 9 to the one side.

Accordingly, by a simple configuration that the inclined surface 831*a* provided in the leg portion 83 is provided to make contact with the movable board 9, the movement of the knob 8 in the push direction (axis line X1 direction) is changed into the movement of the movable board 9 in the radial direction (axis line Y direction) to the push direction to enable the movable contact point 9*a* making contact with the fixed contact point 7*a* to slide in the radial direction.

Here, the movable board 9 has the contact portion 92 with the outer periphery of which the inclined surface 831*a* makes contact, and the outer peripheral surface (contact surface 92*a*) of the contact portion 92 is formed in an arc shape in a cross sectional view in the axis line Y direction, and the inclined surface 831*a* makes point-contact with the outer peripheral surface of the contact portion 92.

Thereby, since it is possible to reduce a frictional resistance at the time of moving the movable board 9 by the leg portion 83 (contact surface 831*a*) that has moved to the operation direction side of the knob 8 by the push operation of the knob 8, it is possible to smoothly perform the push operation of the knob 8 in the push switch 2.

The spring Sp1 (first urging unit) urging the knob 8 in the opposite side to the push direction, and the spring Sp2 (second urging unit) urging the movable board 9 in the other side in the radial direction (axis line Y direction) of the push direction are provided, wherein the spring Sp1 is provided in one side of the knob 8 in the radial direction for the urging force from the spring Sp1 to act on the one side of the knob 8, and the leg portion 83 is provided on the other side of the knob 8 for the urging force from the spring Sp2 to act on the other side of the knob 8.

According to this configuration, the urging force acting on the one side of the knob 8 in the radial direction is made to be the same as the urging force acting on the other side by adjusting the urging force of the spring Sp1 and that of the spring Sp2, and thereby, it is possible to prevent the knob 8 from moving in a state of being inclined to the push direction at the time the knob 8 moves in the push direction.

Since it is possible to prevent the occurrence of an obstacle in the movement of the knob 8 due to a state where the knob 8 is inclined to the push direction, it is possible to appropriately suppress occurrence of malfunction of the push switch due to occurrence of the obstacle in the movement of the knob.

Further, at the time the knob 8 returns back to the reference position shown in FIG. 5A from the operation position shown in FIG. 5B by the urging forces of the spring Sp1 and the spring Sp2, the urging forces acting on the forward side and on the backward side of the knob 8 in the front-back direction of the switch device 1 can be made to be the same. Therefore, the knob 8 can be returned back to the reference position while holding the knob 8 in a horizontal state.

Further, in a case of the conventional push switch in which the movable board 104 having the movable contact point 104*a* is moved in the push direction of the knob 107 to cause the movable contact point 104*a* having made contact with the fixed contact point 103*a* to slide (refer to FIG. 6), the leg portions 108A and 108B are respectively provided on one side and the other side of the knob 107 in the longitudinal direction for pushing and moving the movable board 104 equally.

Therefore, a size of the movable board 104 becomes inevitably large for ensuring strength of the movable board 104 to the push forces acting from the leg portions 108A and 108B.

According to the configuration as described above, since the section of the movable board 9 that is pushed by the leg portion 83 is only one section of the contact point 92, a size of the movable board 9 can be made smaller as compared to a case of the conventional push switch. Thereby, the push switch 2 can be downsized as compared to the conventional push switch.

A freedom degree of the layout in the case 5 is improved corresponding to the downsizing of the movable board 9, and also since materials necessary for producing the push switch 2 can be reduced by the downsizing of the case 5 following the downsizing of the movable board 9, it is possible to reduce manufacturing costs.

In addition, a shape, a size and the like of each member are not limited to those illustrated, but may be arbitrarily set within a range where the operational effect of the present invention can be achieved, corresponding to the installation place, the use aspect or the like.

While only the selected embodiment has been chosen to illustrate the present invention, it will be apparent to those skilled in the art from this disclosure that various changes and modifications can be made therein without departing from the scope of the invention as defined in the appended claims. Furthermore, the foregoing description of the embodiment according to the present invention is provided for illustration only, and not for the purpose of limiting the invention as defined by the appended claims and their equivalents.

DESCRIPTION OF CODES

1 Switch device
2 Push switch
4 Swing switch
5 Case
6 Cover
7 Pole board
7*a* Fixed contact point
8 Knob
9 Movable board
9*a* Movable contact point
61 Support wall portion
62 Opening
71 Terminal holding portion
72 Lower cover portion
73 Projecting portion
74 Step portion
74*a* Inclined surface
75 Guide plate
75*a* Engagement groove
76 Stopper
77 Holding portion
78 Projection
81 Push portion
82 Guide wall
83 Leg portion
83*a* Guide projection
83*b* Guide groove
91 Main body portion
92 Contact portion
93 Arm portion
93*a* Engagement portion
94 Projection
95 Spring holding portion
95*a* Accommodation groove
95*b* Spring holding hole
612 to 615 Side wall portion
612*a*, 615*a* Guide groove
612*b*, 613*b* Engagement portion
614*a* Guide projection
616 Mounting wall
810 Upper wall portion
811 Peripheral wall portion
821, 822 Wall portion
822*a* Opening portion
831 Tip end portion
831*a* Inclined surface
P Contact point
Sp, Sp1, Sp2, Sp3 Spring
X Axis line
X1 Axis line
Y Axis line

What is claimed is:

1. A push switch comprising:

a fixed contact point;

a movable contact point that movably makes contact with the fixed contact point; and a knob that causes the movable contact point in contact with the fixed contact point to slide thereon by a push operation of the knob, thereby connecting/disconnecting the movable contact point and the fixed contact point, a cover in which the knob is assembled, and a guide wall guiding movement of the knob in an axial direction, wherein a sliding direction of the movable contact point is set to a radial direction to the push direction of the knob, wherein the movable contact point is provided in a movable board that is movable in the radial direction, wherein the knob includes a leg portion extending in the push direction and an inclined portion provided in one side of a tip end of the leg portion in the radial direction, the inclined portion formed in such a direction that a width of the leg portion in the radial direction is narrower toward the tip end, wherein the knob is provided such that the inclined portion makes contact with the movable board, wherein a side wall portion of the cover is between the guide wall and a peripheral wall portion of the knob, and wherein a projection provided in a wall portion of the guide wall is engaged to a guide groove formed on an inner side surface of the side wall portion.

2. A push switch comprising:

a fixed contact point;

a movable contact point that movably makes contact with the fixed contact point; and a knob that causes the movable contact point in contact with the fixed contact point to slide thereon by a push operation of the knob, thereby connecting/disconnecting the movable contact point and the fixed contact point, a cover in which the knob is assembled, a plate spring provided in a mounting wall of the cover, and a heart cam having a cam groove provided in the leg portion of the knob and a lock pin configured to engage with the cam groove wherein a sliding direction of the movable contact point is set to a radial direction to the push direction of the knob, wherein the movable contact point is provided in a movable board that is movable in the radial direction, wherein the knob includes a leg portion extending in the push direction and an inclined portion provided in one side of a tip end of the leg portion in the radial direction, the inclined portion formed in such a direction that a width of the leg portion in the radial direction is narrower toward the tip end, and wherein the knob is provided such that the inclined portion makes contact with the movable board, and wherein the lock pin is provided to penetrate through the mounting wall such that one end is caused to make push-contact with the cam groove by an urging force from the plate spring.

* * * * *